US005755172A

United States Patent [19]

Fryburg

[11] Patent Number: 5,755,172

[45] Date of Patent: May 26, 1998

[54] UNDERWATER LIFTING APPARATUS

[75] Inventor: Richard G. Fryburg, Cranston, R.I.

[73] Assignee: Inflatable Technology Corporation, Providence, R.I.

[21] Appl. No.: 715,103

[22] Filed: Sep. 18, 1996

[51] Int. Cl.[6] ..... B63C 7/00

[52] U.S. Cl. ..... 114/52

[58] Field of Search ..... 114/52–54; 441/28–30

[56] References Cited

U.S. PATENT DOCUMENTS

| | | | |
|---|---|---|---|
| 3,182,928 | 5/1965 | Gaylord | 441/42 |
| 3,710,746 | 1/1973 | Mcdonald | 114/52 |
| 4,055,632 | 10/1977 | Hoffman et al. . | |
| 4,658,745 | 4/1987 | Buccher | 114/54 |
| 4,979,451 | 12/1990 | Searle | 114/54 |

*Primary Examiner*—Jesus D. Sotelo
*Attorney, Agent, or Firm*—Salter & Michaelson

[57] ABSTRACT

An underwater lifting apparatus includes a lift bag having an inflatable bladder which is capable of receiving gas therein for inflating the lift bag, the bladder having a sleeve mounted on its outer surface. A pressurized canister is received within the sleeve of the lift bag for inflating the bladder of the lift bag. The pressurized canister is adapted to store gas under pressure therein. A plurality of valves are provided for delivering pressurized gas from the canister into the bladder of the lift bag, the valves being suitably mounted on the lift bag. Rigging is mounted on the lift bag for securing the lift bag to an object requiring removal from underwater.

7 Claims, 3 Drawing Sheets

UNDERWATER LIFTING APPARATUS

BACKGROUND AND SUMMARY OF THE INVENTION

This invention relates generally to underwater lifting apparatuses, and more particularly to an underwater lifting apparatus which is suited for recovering submerged vehicles and persons.

Underwater lifting apparatuses are well-known in the art of underwater recovery of vehicles, small water vessels, persons, and the like. Reference can be made to U.S. Pat. Nos. 3,710,746 to Mcdonald, 4,055,632 to Hoffman et al., 4,658,745 to Buecher, and 4,979,451 to Searle as representative prior art. The patent to Mcdonald discloses a lifting device having a cylindrical drum and a plurality of high pressure storage bottles which are strapped to the drum. Air pressure is delivered from the bottles to the interior of the drum via suitable valves. Sea water can also be introduced into and exhausted from the interior of the drum for controlling the buoyancy of the device.

Hoffman et al. is directed to a collapsible lift bag which is inflated by a pressurized gas container which is, in its stowed configuration, detached from the lift bag. In operation, the gas container must be threaded onto a valve of the lift bag for attaching the container thereto before the lift bag can be filled with gas.

Buecher also discloses a collapsible lift bag having a pressurized canister in the form of a scuba bottle which is attached to the lift bag by what appears to be cables. The lift bag has a pair of lift lines which are attached thereto for lifting objects.

Each of the foregoing apparatuses described above suffer from the disadvantage that when in their "stowed" or "compact" configuration prior to inflation, they are still bulky to handle and difficult to transport. Moreover, due to their bulkiness, these apparatuses are difficult to operate and time-consuming to deploy. There is presently a need in the underwater recovery area for an apparatus which, in its stowed form, is compact and easy to carry, and which, when inflated for use, is strong, durable, and capable of lifting heavy objects.

The present invention is designed to overcome many of the aforementioned disadvantages of the prior art, and comprises a lift bag having an inflatable bladder which is capable of receiving gas therein for inflating the lift bag. The bladder has a sleeve mounted on its outer surface. A pressurized canister is received within the sleeve of the lift bag for inflating the bladder of the lift bag. The pressurized canister is adapted to store gas under pressure therein. A plurality of valves are provided for delivering pressurized gas from the canister into the bladder of the lift bag, the valves being suitably mounted on the lift bag. Rigging is mounted on the lift bag for securing the lift bag to an object requiring removal from underwater.

More specifically, a one-way valve is sealably mounted on the lift bag, and a valve is mounted on the canister for controlling the delivery of pressurized gas into the bladder of the lift bag. A release valve exhausts gas from the bladder of the lift bag should too much gas be delivered therein. Moreover, the rigging comprises a pair of oppositely positioned, spaced-apart straps, each strap extending through aligned apertures formed in an outer protective sheath which is suitably attached to the bladder of the lift bag for securing the strap thereto. The rigging further includes, for each strap, a ring mounted by the strap to the bladder for securing a chain or strap thereto.

In one aspect of the present invention, a carrying case receives the lift bag in its deflated configuration for carrying and storing the apparatus. The carrying case has a flexible jacket with an opening formed therein, the opening being closeable by closing means comprising a zipper. A pair of straps are attached to the jacket for carrying for case by hand.

Accordingly, among the several objects of the present invention are the provision of an underwater lifting apparatus which is capable of lifting heavy objects, such as submerged vehicles and water vessels; the provision of such an apparatus which, in its stowed configuration, is relatively compact, easy to carry and light-weight; the provision of such an apparatus which is easy to operate and employ; the provision of such an apparatus which is capable of being easily secured to objects having varying shapes and sizes; the provision of such an apparatus having means for controlling its buoyancy; the provision of such an apparatus which is simple and rugged in design; and the provision of such an apparatus which can be inexpensively manufactured from readily available materials.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
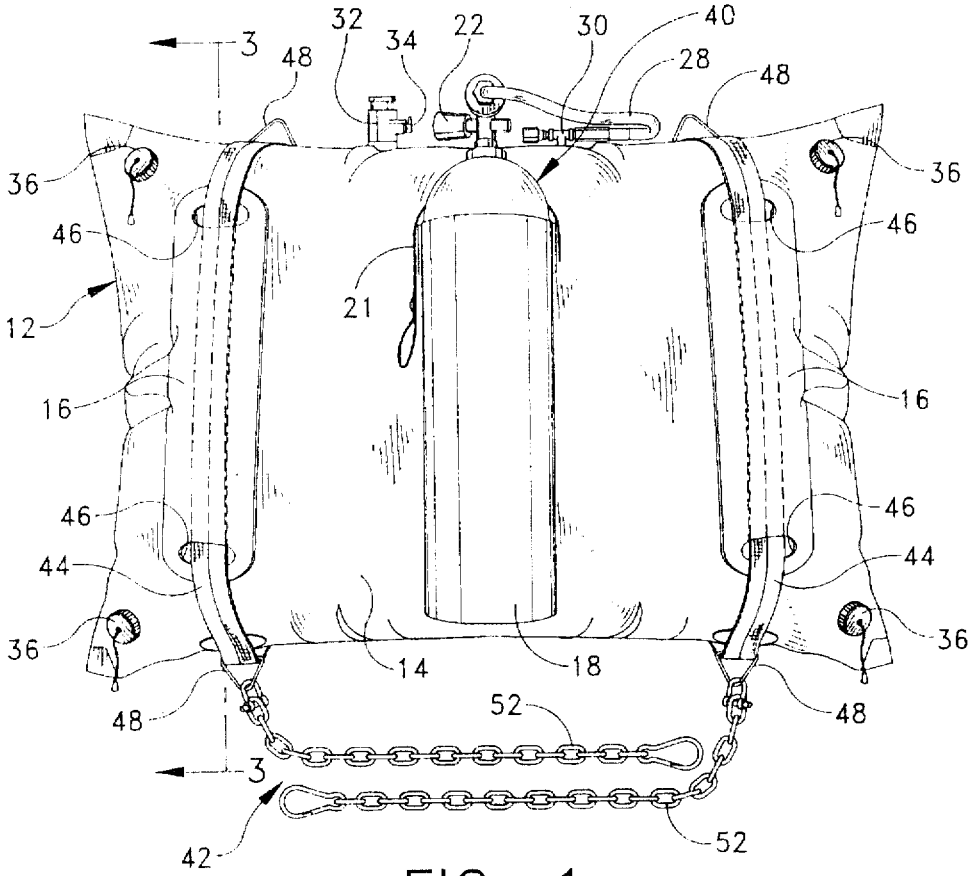
FIG. 1 is a front elevational view of an underwater lifting apparatus of the present invention.

Referring now to the drawings, and more particularly to FIG. 1, there is generally indicated at 10 an underwater lifting apparatus which is specifically designed for recovering submerged objects, such as smaller water vessels, vehicles, or persons trapped underwater. The apparatus 10 of the present invention is compact in its pre-deployed configuration so that it is convenient to store and easy to carry. Moreover, since the apparatus 10 is of simple construction, it is easy to operate and manipulate when conducting underwater recovery operations. The apparatus 10 is capable of lifting over 2000 pounds while having an overall pre-deployed dimension of approximately 51 inches long by 20 inches high by 10 inches wide and weighing about 65 pounds.

Figure 3:
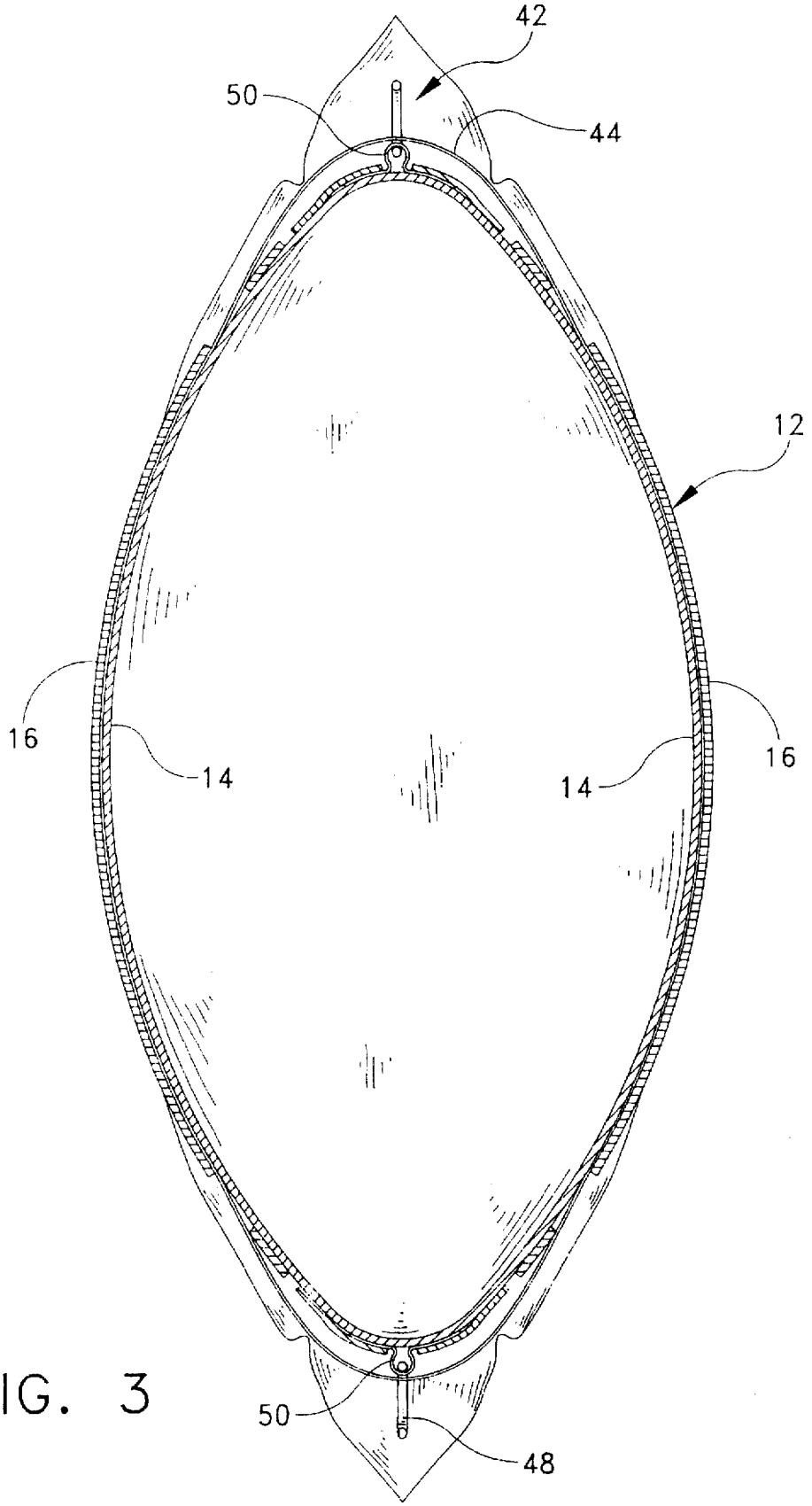
FIG. 3 is a cross-sectional view taken along line 3—3 of FIG. 1.

As shown in FIGS. 1 and 3, the apparatus 10 comprises a lift bag, generally indicated at 12, having an inflatable bladder 14 which is capable of receiving gas therein for inflating the lift bag 12, and a plurality of outer sheaths 16 for preventing abrasive forces from damaging the bladder, and for carrying structural loads. The sheaths 16 are attached (e.g., by dielectric welding) to the bladder, and are located strategically in predetermined positions which will be described in greater detail below. Preferably, the bladder 14 of the lift bag 12 is rectangularly-shaped when inflated and fabricated from nylon fabric which is coated on both sides with high strength urethane. This fabric material is highly resistant to abrasion, and to damage caused by fuel and oil. Referring to FIG. 3, the bladder 14 forms a completely enclosed, air-tight envelope which is capable of receiving pressurized gas (e.g., air) therein for inflating the lift bag 12. The bladder 14 has a piece of fabric sewn thereto on its outer surface for forming an elongate sleeve 18, the purpose of which will also be described in greater detail below.

Generally indicated at 20 is a pressurized canister for supplying pressurized gas into the inflatable bladder 14 of the lift bag 12 to inflate the lift bag. The pressurized canister 20 is of the type containing pressurized gas (e.g., air) which is commonly used by scuba divers, and is oftentimes referred to as a "scuba cylinder". The pressurized canister 20 is also of the type which can be easily replaced when it becomes depleted should additional pressurized gas be required. As shown in FIG. 1, the canister 20 is received within the sleeve 18 of the lift bag 12 so that it is easily carried by the lift bag 12 and conveniently located. Preferably, the sleeve 18 is sized for snugly receiving the canister 20 therein and for substantially covering the canister, thereby any unwanted removal of the canister from the lift bag 12 when employing the apparatus 10 underwater. A strap 21 is attached to the sleeve 18 at one side thereof for securing the canister 20 in place. As illustrated in FIG. 1, the strap 21 extends over the top of the canister and is secured to the sleeve 18 at its other side by any suitable means, e.g., a snap fastener, hook and loop fastener material, and the like. As mentioned above, the strap 21 ensures that the canister 20 is held in place with respect to the lift bag 12 during transport and use.

The canister 20 is opened by means of a canister valve 22 mounted on the upper end of the canister exposed from the sleeve 18. The canister valve 22 is operable to move a valve member (not shown) between an open position in which air is exhausted from the canister 20 and closed position. A yoke 24 attached to the valve 22 of the canister in the well-known manner and is secured thereto by set screw 26. Air is delivered from the canister 20 to a flexible line 28 which is in fluid communication at one end thereof with the canister valve 22 and yoke 24. The flexible line 28 is connected at its other end with a one-way valve 30 which is sealably mounted on the bladder 14 of the lift bag 12 at the top of the lift bag as illustrated in FIG. 1. The flexible line 28 is threadably secured to the one-way valve 30, the one-way valve allowing pressurized gas to enter the bladder 14, but preventing gas within the bladder from escaping when the valve assembly 22 of the canister 20 is closed. A quick-connect 31 is threaded onto the one-way valve 30 for enabling air from another source to be deposited within the lift bag 12.

Figure 2:
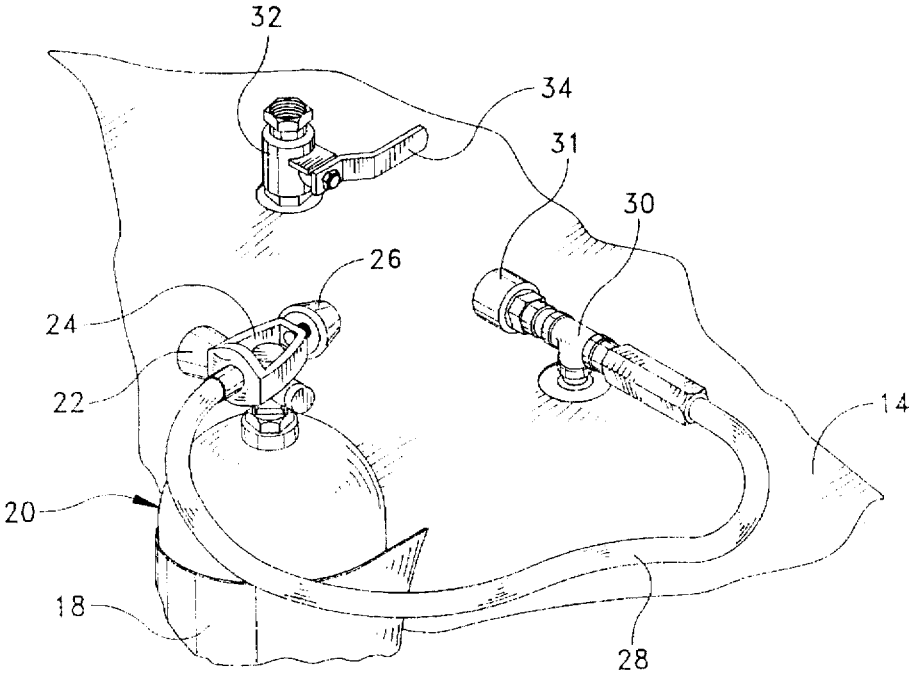
FIG. 2 is an enlarged perspective view of a bag inflation and deflation assembly thereof.

A release valve assembly 32 is sealably mounted on the bladder 14 at the top of the lift bag 12 adjacent to the one-way valve 30. The release valve assembly 32 also has a valve member (not shown) which can be opened and closed for exhausting gas from the bladder 14 of the lift bag 12 in the well-known manner, and as illustrated in FIG. 2, is positioned next to the canister 20 and one-way valve 30. A rotatable lever 34 opens and closes the valve member of the release valve assembly 32. This valve assembly 32 is designed for exhausting a large quantity of gas quickly from the bladder 14 of the lift bag 12.

In addition, the operator of the apparatus 10 can release gas from the bag 12 by unscrewing any one of four conveniently located relief valves, each indicated at 36, located at the four corners of the lift bag 12 illustrated in FIG. 1. The relief valves are provided for ensuring that the lift bag 12 is not over inflated, and are preferably capable of exhausting air from the lift bag 12 upon reaching some predetermined pressure (e.g., 2 psi absolute).

The arrangement is such that the bladder 14 of the lift bag 12 is filled with pressurized gas by opening the canister valve 22. This results in pressurized gas being delivered from the canister 20 to the one-way valve 30 and further to the interior of the bladder 14. If, for example, the canister 20 becomes depleted, the yoke 24 is removed from the canister 20 by unscrewing set screw 26, and the canister 20 is removed from the sleeve 18 and replaced with a new canister. In order to slide the canister 20 out of the sleeve 18, the strap 21 must be released. It should be observed that the release valve assembly 32 can release gas from the lift bag 12 if the buoyancy of the apparatus 10 needs adjustment.

For securing the lift bag 12 to an object requiring removal from underwater (e.g., an automobile 38 in FIG. 5), rigging, generally indicated at 42, is attached to the sheaths 16 of the lift bag 12. Referring to FIGS. 1 and 3, the rigging 42 comprises a pair of oppositely positioned spaced-apart straps 44, each strap 44 being aligned with the outer sheaths 16 so that they extend through apertures 46 formed in the outer sheaths 16 of the lift bag 12 for securing the strap 44 thereto. Preferably, the straps 44 are fabricated from durable nylon or similar materials which is resistant to abrasion and capable of withstanding heavy loads. For each strap 44, a pair of triangularly-shaped rings 48 are mounted by a flexible strip 50 of material (as by sewing) onto the bladder 14 for securing a chain 52 thereto. The rings 48 receive the straps 44 therein, and are adapted to receive the chain 52, or other similar rigging apparatus (straps) for lifting objects. The straps 44 spread out the load of the object being lifted around the entire lift bag 12 so that tearing and any similar damage to the bag 12 is prevented from occurring.

Figure 4:
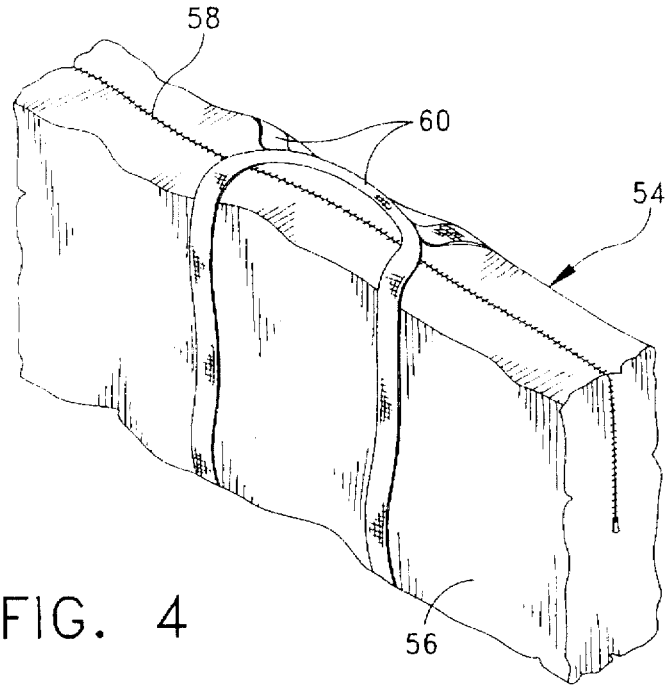
FIG. 4 is a perspective view of the apparatus in its stowed configuration in a carrying case.

Turning now to FIG. 4, there is generally indicated at 54 a carrying case for receiving the lift bag 12 in its deflated configuration, the canister 20 (which is positioned in the sleeve 18 of the lift bag), the valves 30, 32, and the rigging 42. The carrying case 54 is sized to receive the lift bag 12, and the other components of the apparatus 10, after the lift bag is suitably folded to a compact or stowed configuration. The carrying case 54 has a flexible jacket 56 fabricated from durable fabric with an opening (not designated) formed therein for receiving the apparatus. The jacket opening is closeable by suitable means, such as by a zipper 58, buttons or any similar devices. A pair of straps 60 are stitched to the jacket 56 for carrying the case 54 by hand. As shown in FIG. 4, the straps 60 enable the apparatus operator to carry it much like a suitcase. This is feasible since the apparatus 10, including all of its components, only weighs approximately 65 pounds.

Figure 5:
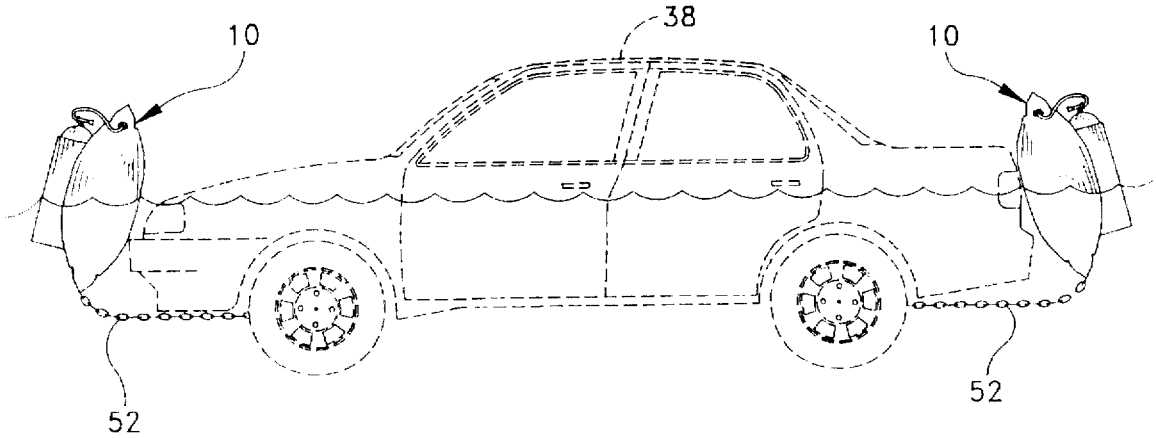
FIG. 5 is an elevational view of a plurality of apparatuses of the present invention being used to lift an automobile.

Turning now to FIG. 5 of the drawings, there is illustrated an exemplary use of apparatus 10 wherein the apparatus 10 is shown lifting the automobile 38. More particularly, the lifting of the automobile 38 requires either two or four apparatuses 10 of the present invention for lifting a standard size automobile. One way of lifting the automobile 38 is by placing a pair of chains 52 underneath each end of the automobile 38 and attaching the free ends of the chains to either two or four apparatuses 10 depending upon the size and weight of the automobile. Another way is by securing the lower free ends of each chain 52 to the underneath of the automobile 38 at its four corners and attaching the lifting apparatus 10 their upper free ends.

In either situation, the automobile 38 is lifted by opening the canister valve 22 and inflating the lift bag 12. If too much pressurized gas is delivered to the lift bag 12, gas can be exhausted from the lift bag 12 by either opening the release valve assembly 32, or by opening any one of the four relief valves 36, or by setting the relief valves 36 to release air from the lift bag 12 upon reaching a predetermined air pressure (e.g., 2 psi absolute). This can be performed to either control the raising of the object upon which the apparatus 10 is attached, or if too much gas is inside the bladder 14 of the lift bag 12 and there is risk that it may explode.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An underwater lifting apparatus comprising:

a lift bag having an inflatable bladder which is capable of receiving gas therein for inflating the lift bag, said bladder having a sleeve mounted on its outer surface;

a pressurized canister receivable within the sleeve of the lift bag for inflating the bladder of the lift bag, said pressurized canister being adapted to store gas under pressure therein, wherein said sleeve is sized for snugly receiving said canister therein;

means for delivering pressurized gas from the canister into the bladder of the lift bag, said delivering means being mounted on said lift bag;

means for securing the lift bag to an object requiring removal from underwater, said securing means being attached to the lift bag; and a strap attached at one end thereof to the sleeve at one side thereof, said strap extending over the top of the canister and its free end being secured to said sleeve at its other side thereof for securing the canister in the sleeve.

2. An underwater lifting apparatus comprising:

a lift bag having an inflatable bladder which is capable of receiving gas therein for inflating the lift bag, said bladder having a sleeve mounted on its outer surface;

a pressurized canister receivable within the sleeve of the lift bag for inflating the bladder of the lift bag, said pressurized canister being adapted to store gas under pressure therein;

means for delivering pressurized gas from the canister into the bladder of the lift bag, said delivering means being mounted on said lift bag; and means for securing the lift bag to an object requiring removal from underwater, said securing means being attached to the lift bag, said securing means comprising a pair of oppositely positioned straps attached in spaced relation to the lift bag.

3. An apparatus as set forth in claim 2, said securing means further comprising, for each strap, a ring mounted by a flexible strip to said bladder for securing a chain or strap thereto.

4. An underwater lifting apparatus comprising:

a lift bag having an inflatable bladder which is capable of receiving gas therein for inflating the lift bag, said bladder having a sleeve mounted on its outer surface;

a pressurized canister receivable within the sleeve of the lift bag for inflating the bladder of the lift bag, said pressurized canister being adapted to store gas under pressure therein;

means for delivering pressurized gas from the canister into the bladder of the lift bag, said delivering means being mounted on said lift bag;

means for securing the lift bag to an object requiring removal from underwater, said securing means being attached to the lift bag; and a carrying case for receiving the lift bag in its deflated configuration, said canister, said delivering means, and said securing means.

5. An apparatus as set forth in claim 4, said carrying case having a flexible jacket with an opening formed therein.

6. An apparatus as set forth in claim 5, said opening being closeable by closing means comprising a zipper.

7. An apparatus as set forth in claim 5, said carrying case further comprising a strap attached to said jacket for carrying said case.

* * * * *